US008323058B2

(12) United States Patent
Flaherty et al.

(10) Patent No.: US 8,323,058 B2
(45) Date of Patent: Dec. 4, 2012

(54) DIGITAL, SMALL SIGNAL AND RF MICROWAVE COAXIAL SUBMINIATURE PUSH-ON DIFFERENTIAL PAIR SYSTEM

(75) Inventors: Thomas E Flaherty, Surprise, AZ (US); Eric James Paulus, Phoenix, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 13/074,106

(22) Filed: Mar. 29, 2011

(65) Prior Publication Data

US 2011/0237124 A1 Sep. 29, 2011

Related U.S. Application Data

(60) Provisional application No. 61/318,558, filed on Mar. 29, 2010.

(51) Int. Cl.
*H01R 13/64* (2006.01)

(52) U.S. Cl. ..... 439/680

(58) Field of Classification Search ..... 439/677, 439/680, 681, 79, 541.5
See application file for complete search history.

(56) References Cited

U.S. PATENT DOCUMENTS

| | | | | |
|---|---|---|---|---|
| 3,281,756 | A * | 10/1966 | O'Keefe et al. | 439/320 |
| 3,614,711 | A | 10/1971 | Anderson et al. | 339/90 R |
| 4,206,963 | A * | 6/1980 | English et al. | 439/581 |
| 4,728,301 | A * | 3/1988 | Hemmer et al. | 439/578 |
| 4,846,731 | A * | 7/1989 | Alwine | 439/651 |
| 4,925,403 | A * | 5/1990 | Zorzy | 439/578 |
| 4,938,718 | A | 7/1990 | Guendel | 439/680 |
| 5,217,392 | A * | 6/1993 | Hosler, Sr. | 439/585 |
| 5,817,978 | A * | 10/1998 | Hermant et al. | 174/75 C |
| 6,174,206 | B1 * | 1/2001 | Yentile et al. | 439/638 |
| 6,238,240 | B1 * | 5/2001 | Yu | 439/541.5 |
| 7,112,078 | B2 * | 9/2006 | Czikora | 439/248 |
| 7,347,727 | B2 * | 3/2008 | Wlos et al. | 439/578 |
| 7,442,080 | B1 * | 10/2008 | Tsen | 439/578 |
| 7,478,475 | B2 * | 1/2009 | Hall | 29/869 |
| 2006/0194465 | A1 * | 8/2006 | Czikora | 439/248 |
| 2006/0258209 | A1 * | 11/2006 | Hall | 439/578 |
| 2009/0264003 | A1 | 10/2009 | Hertzler et al. | 439/299 |
| 2010/0007441 | A1 * | 1/2010 | Yagisawa et al. | 333/185 |
| 2011/0151714 | A1 * | 6/2011 | Flaherty et al. | 439/578 |
| 2011/0237123 | A1 * | 9/2011 | Burris et al. | 439/578 |
| 2011/0237124 | A1 * | 9/2011 | Flaherty et al. | 439/578 |

FOREIGN PATENT DOCUMENTS

EP 1603200 A1 12/2005

OTHER PUBLICATIONS

Patent Cooperation Treaty Form ISA/220, Jul. 1, 2011, pp. 1-2.

* cited by examiner

*Primary Examiner* — Ross Gushi

(57) ABSTRACT

The differential pair system includes a push-on high frequency differential interconnect and push-on high frequency differential connector. The system allows for blind mating of the two components, using a keying system for the two electrical conductors to be axially and radially aligned.

16 Claims, 5 Drawing Sheets

DIGITAL, SMALL SIGNAL AND RF MICROWAVE COAXIAL SUBMINIATURE PUSH-ON DIFFERENTIAL PAIR SYSTEM

CROSS-REFERENCE TO RELATED APPLICATIONS

This application claims the benefit of, and priority to U.S. Provisional Patent Application No. 61/318,558 filed on Mar. 29, 2010 entitled, "Digital, Small Signal and RF Microwave Coaxial Subminiature Push-On Differential Pair System", the content of which is relied upon and incorporated herein by reference in its entirety.

BACKGROUND OF THE INVENTION

1. Field of the Invention

The present invention relates generally to a digital, small signal and RF microwave frequency coaxial differential pair connector interconnect and connectors that includes a push-on interface.

2. Technical Background

Within the technical field of digital, small signal and RF microwave frequency coaxial connectors there exists a subset of connector interface designs engageable without the aid of external coupling mechanisms such as split keying dielectric components. These interconnect systems are known in the industry as Twin axial TNC's and BNC's. Twin axial, differential pair interconnects are used to attach coaxial cables or modules to another object, such as a corresponding connector on an appliance or junction having a terminal, or port, adapted to engage the connector.

Typically existing differential pair connectors utilize a coupling system that includes a female with spring fingers and a corresponding male port configured to receive the female connector with the use of a coupling nut that is either slotted or threaded. However, when confronted with two electrical conductors in the system, the use of a coupling nut becomes impractical.

It would be an advantage, therefore, to provided a streamlined, cost competitive push-on, self aligning interconnect locking system integral to the connector that provides for easy installation and removal with the use of tools yet be positively mated during use. It would also be advantageous to provide the interconnect system to reduce the footprint taken up by the much larger interconnects in the market.

SUMMARY OF THE INVENTION

In one aspect, a push-on high frequency differential interconnect that includes a tubular body having a central opening, a first end, and a second end, the first end and second end are segmented into a plurality of segmented portions, the plurality of segmented portions biased radially outward to engage and retain a corresponding connector, at least one of the plurality of segmented portions at each of the first and second ends biased radially outward beyond other segmented portions of the plurality of segmented portions to provide a key for the corresponding connector and a dielectric member disposed in the central opening of the tubular body, the dielectric member having two openings therein to receive two electrical conductors, and an electrical conductor disposed in each of the two openings in the dielectric member.

In some embodiments, the at least one of the plurality of segmented portions at each of the first and second ends biased radially outward beyond other segmented portions of the plurality of segmented portions comprises two of the plurality of segmented portions.

In some embodiments, the two openings in the dielectric member and the at least one of the plurality of segmented portions lie on a single plane.

In yet another aspect, a push-on high frequency differential connector includes an outer body having an outer surface, an inner surface, a front end, and a back end, the inner surface defining an opening extending between the front end and the back end, the inner surface having a slot extending from the front end to a middle portion, a dielectric member inserted into the opening at the back end of the outer body, the dielectric member having two openings therein, two electrical contacts disposed in the openings in the dielectric member, the electrical contacts extending towards the front end and beyond a front end of dielectric member, and a dielectric spacer engaging the two electrical contacts beyond the outer surface of the outer body.

In still yet another aspect, a push-on high frequency differential pair system that includes a push-on high frequency differential interconnect, the interconnect includes a tubular body having a central opening, a first end, and a second end, the first end and second end are segmented into a plurality of segmented portions, the plurality of segmented portions biased radially outward to engage and retain a corresponding connector, at least one of the plurality of segmented portions at each of the first and second ends biased radially outward beyond other segmented portions of the plurality of segmented portions to provide a key for the corresponding connector, a dielectric member disposed in the central opening of the tubular body, the dielectric member having two openings therein to receive two electrical conductors, and an electrical conductor disposed in each of the two openings in the dielectric member, and a push-on high frequency differential connector that includes an outer body having an outer surface, an inner surface, a front end, and a back end, the inner surface defining an opening extending between the front end and the back end, the inner surface having a slot extending from the front end to a middle portion, a dielectric member inserted into the opening at the back end of the outer body, the dielectric member having two openings therein, two electrical contacts disposed in the openings in the dielectric member, the electrical contacts extending from the back end towards the front end and beyond a front end of dielectric member, the electric contacts extending radially outward from the opening beyond the outer surface, and a dielectric spacer engaging the two electrical contacts beyond the outer surface of the outer body.

Accordingly, a simple connector is disclosed herein that can easily be produced from a small number of components. The connector preferably forms a reliable electrical RF microwave connection with low mechanical engage and disengage forces. Furthermore, the connector disclosed herein provides an improved electrical performance up to 40 GHz.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
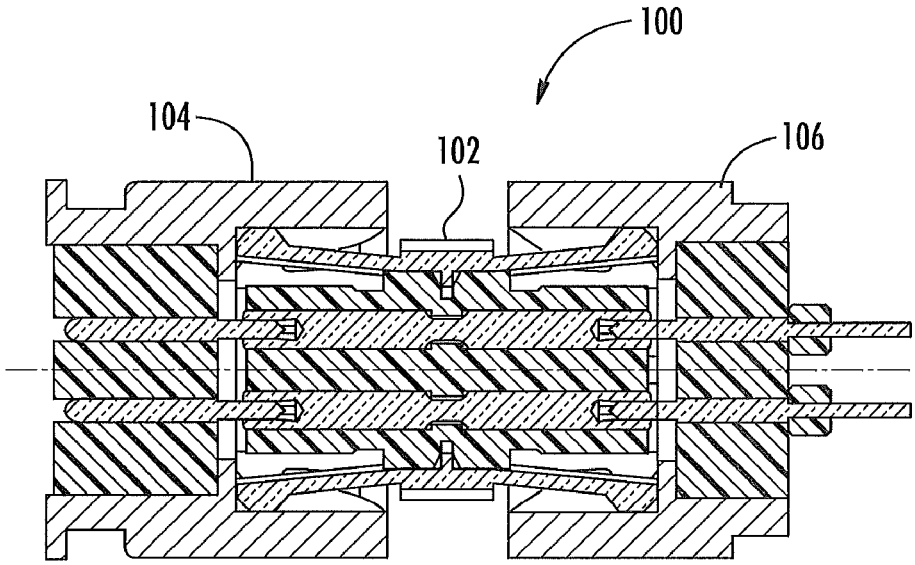
FIG. 1 is a cross sectional view of one embodiment of a differential interconnect and connectors according to the present invention.
Figure 2:
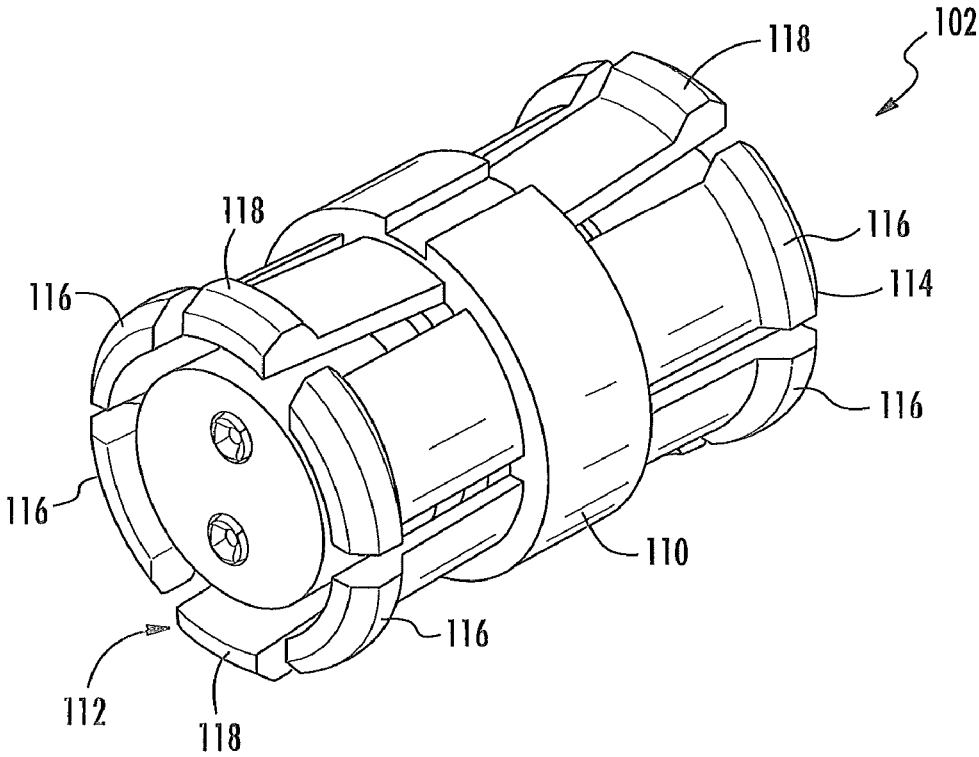
FIG. 2 is a perspective view of the differential interconnect of FIG. 1.
Figure 3:
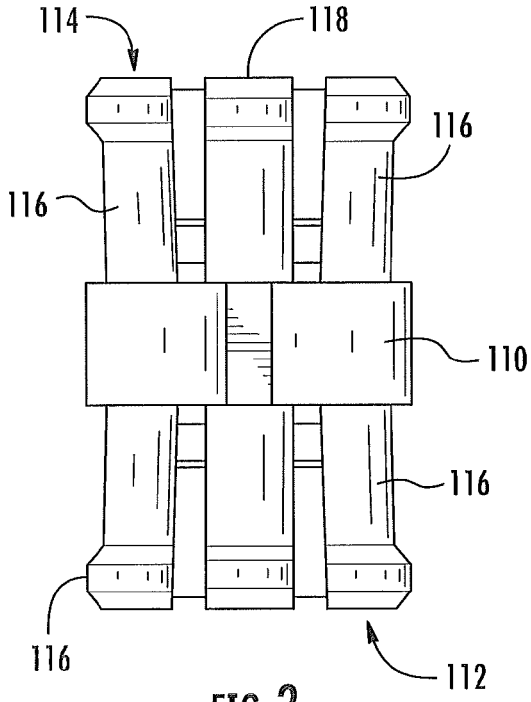
FIG. 3 is a top view of the differential interconnect of FIG. 1.
Figure 4:
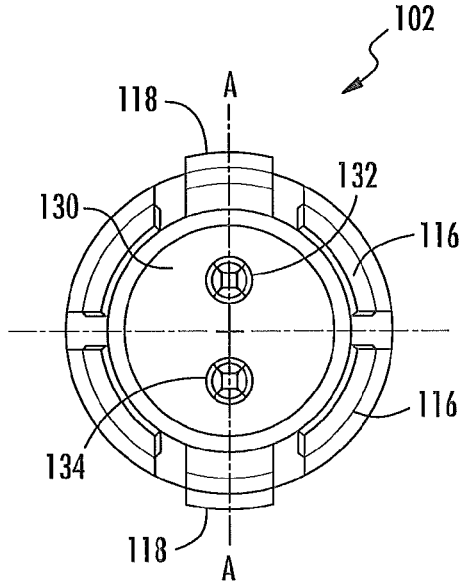
FIG. 4 is a front view of the differential interconnect of FIG. 1.
Figure 5:
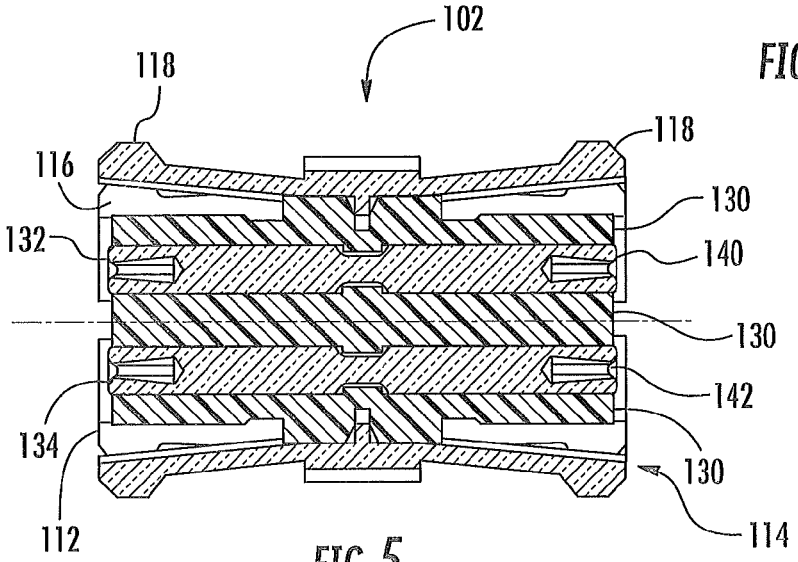
FIG. 5 is a cross-sectional view of the differential interconnect of FIG. 1.
Figure 6:
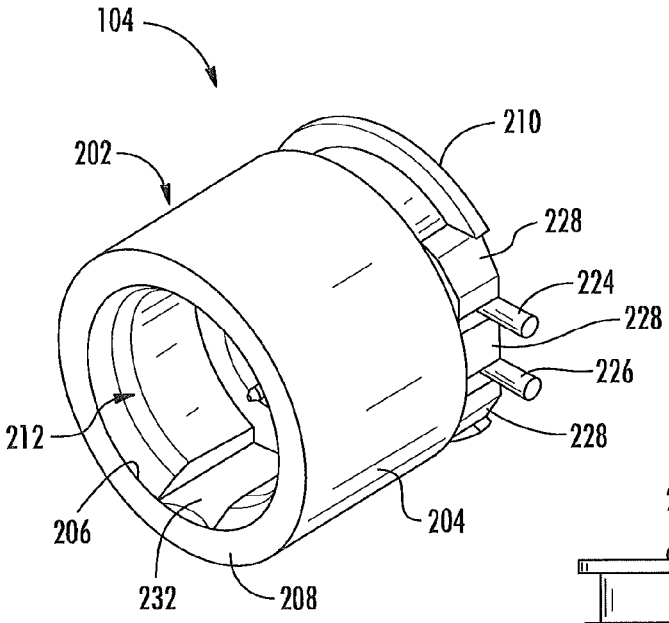
FIG. 6 is a perspective view of one of the connectors of FIG. 1.
Figure 7:
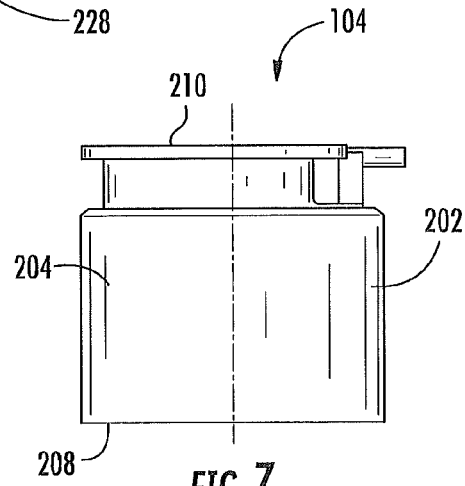
FIG. 7 is a top view of the connector of FIG. 6.

Reference will now be made in detail to the present preferred embodiment(s) of the invention, examples of which are illustrated in the accompanying drawings. Whenever possible, the same reference numerals will be used throughout the drawings to refer to the same or like parts.

Referring to FIGS. 1-13, a connector assembly 100 includes a differential interconnect 102, a first connector 104, and a second connector 106. Generally, the connector assembly 100 allows for the connection, and in particular, the blind mating of the first connector 104 and the second connector 106. As can be seen from the figures, as well as being described above, the connector assembly 100 provides for a quick way to engage and disengage differential pair interconnects that use push-on technology.

Turning now to FIGS. 2-5, the differential interconnect 102, which is a push-on high frequency differential differential interconnect, includes a tubular body 110. The tubular body 110 has at either end 112, 114 a plurality of segmented portions 116. The plurality of segmented portions 116 are typically finger type portions to engage the first connector 104 and the second connector 106. As can be seen in FIG. 1, the plurality of segmented portions 116, which are preferably biased radially outward, engaging an inner portion of the connectors 104, 106 to maintain physical and electrical engagement of the connectors 104,106 with the differential interconnect 102. Two segmented portions 118 of the plurality of segmented portions 116 at each end 112,114 are biased further radially outward that the remainder of the other plurality of segmented portions 116. The two segmented portions 118 provide a keying feature for the first and second connectors 104,106 as described in more detail below. While six segmented portions 116 are illustrated at each end 112,114, any number of segmented portions 116 may be present and still fall within the scope of the present invention. The tubular body 110 is preferably made from a metallic material, for example, beryllium copper, and is plated with a corrosion-resistant, conductive material such as gold.

Also included in the differential interconnect 102 is a dielectric member 130 that is in a center portion of the tubular body 110. The dielectric member 130 has two openings 132, 134 to receive two electrical conductors 140,142. As illustrated best in FIG. 5, the two electrical conductors 140,142 have a female configuration. As discussed below, however, the electrical conductors 140,142 may also have a male configuration.

The two openings 132,134 of the dielectric member 130 lie in the same plane A as the two segmented portions 118. See FIG. 4. This allows for the blind mating of the connectors 104,106 with the differential interconnect 102, as discussed below.

Turning now to FIGS. 6-9, the first connector 104 will be discussed in detail. First connector 104 has an outer body 202, the outer body 202 having an outer surface 204 and inner surface 206. The outer body 202 has a front end 208 and a back end 210 and is generally cylindrical in its configuration. The inner surface 206 defines an opening 212 extending between the front end 208 and the back end 210. The opening 212 is divided into a front portion 212*a* and a rear portion 212*b* by a radially inward directed projection 214 at a middle portion 216, the rear portion 212*b* having a dielectric member 218 inserted therein.

Figure 8:
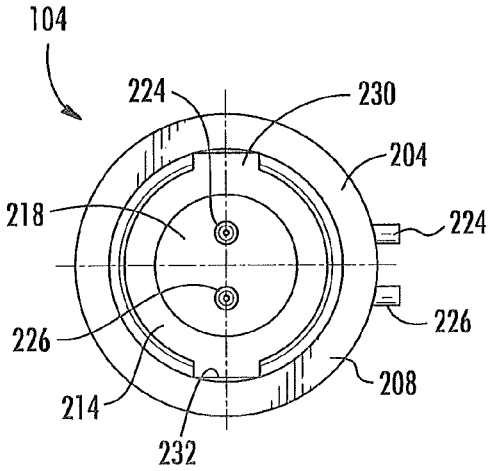
FIG. 8 is a front view of the connector of FIG. 6.
Figure 9:
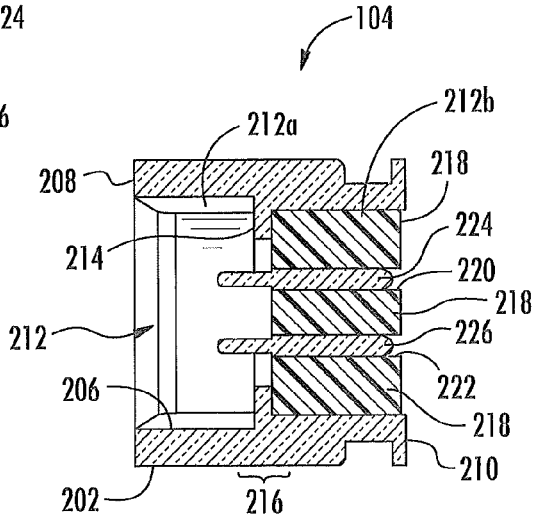
FIG. 9 is a cross sectional view of the connector of FIG. 6.

The dielectric member 218 has two openings 220, 222 to receive two electrical contacts 224, 226. As best illustrated in FIG. 8, the electrical contacts 224,226 extend from the back end 210 through the dielectric member 214 and into the front portion 212*a* of the opening 212. The two electrical contacts 224,226 make a turn at the back end 210 of about 90° and project beyond the outer surface 204 of the outer body 202. See FIGS. 6 and 7. A dielectric spacer 228 surrounds the electrical contacts 224, 226 beyond the outer surface 204 of the outer body 202 to insulate the electrical contacts 224,226 from the outer body 202. The dielectric spacer 228 is preferably an extension of the dielectric member 218, but may be a separate spacer that insulates the two electrical contacts 224, 226. If the dielectric spacer 228 is an extension of the dielectric member 218, then the dielectric member 218 is either a molded or machined element that has a one-piece shoe shape.

The outer body 202 of the first connector 104 has two slots 230,232 (or grooves or other corresponding structure) in the inner surface 206 extending from the front end 208 to the middle portion 216, with which the two segmented portions 118 are aligned. The slots 230,232 are configured to engage and allow the two segmented portions 118 of the differential interconnect 102 to be inserted into the slots 230,232 as the differential interconnect 102 is aligned with and connected to the first connector 104. Thus, the two segmented portions 118 provide a key for inserting the first connector 104 onto the differential interconnect 102 in a correct orientation and eliminate the possibility of stubbing the electrical contacts 224,226 on the differential interconnect 102. Additionally, the two segmented portions 118 allow for axial and rotational alignment of the electrical conductors 224, 226 with the electrical conductors 140, 142 in the differential interconnect 102. While two segmented portions 118 and two slots 230, 232 are illustrated, it is also possible to have only one segmented portion 118 and either one or two slots 230,232 to provide the keying feature described above.

Figure 10:
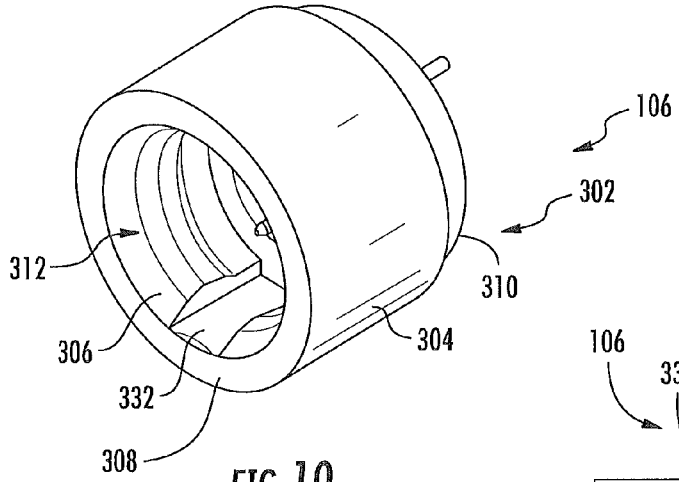
FIG. 10 is a perspective view of the other of the connectors of FIG. 1.
Figure 13:
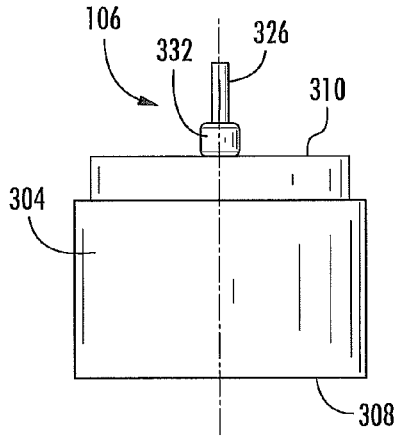
FIG. 13 is a top view of the connector of FIG. 10.
Figure 11:
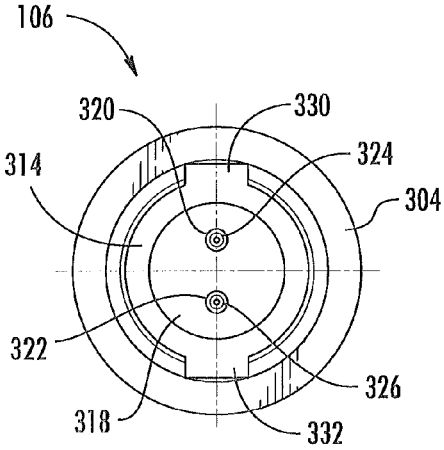
FIG. 11 is a front view of the connector of FIG. 10.
Figure 12:
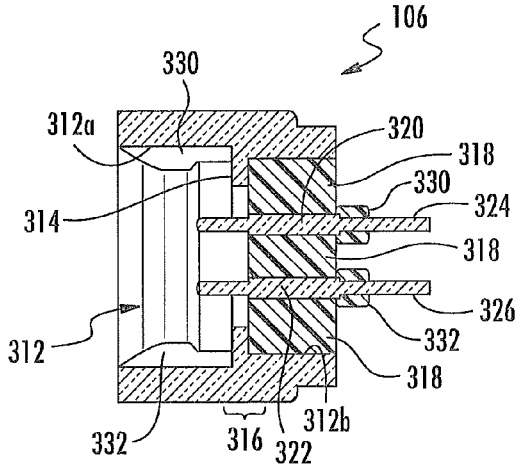
FIG. 12 is a cross-sectional view of the connector of FIG. 10.

The second connector 106 will now be described in conjunction with FIGS. 10-12. The second connector 106 has an outer body 302 with an outer surface 304 and an inner surface 306. The second connector 106 has a front end 308, a back end 310 and is generally cylindrical in configuration. The inner surface 306 defines an opening 312 extending between the front end 308 and the back end 310. The opening 312 is divided into a front portion 312*a* and a rear portion 312*b* by a radially inward directed projection 314 at a middle portion 316, the rear portion 312*b* having a dielectric member 318 inserted therein. The dielectric member 318 has two openings 320, 322 to receive two electrical contacts 324,326. The electrical contacts 324,326 extend beyond the back end 310 and into the front portion 312*a*. Electrical contacts 324,326 also have insulators 330,332 to further insulate the electrical contacts 324,326 and to also provide an alignment mechanism for insertion of the second connector 106 into a blind panel (not shown).

The outer body 302 of the first connector 106 has two slots 330,332 (or grooves or other corresponding structure) in the inner surface 306 extending from the front end 308 to the middle portion 316, with which the two segmented portions 118 are aligned. As with the first connector 104, the two segmented portions 118 functions as a key to ensure the correct positioning of the second connector 106 so that the electrical contacts in the second connector 106 and the differential interconnect 102 are appropriately aligned. The plurality of segmented portions 116 engage the inner surface 306 when the connector 106 is installed into the differential interconnect 102.

Figure 14:
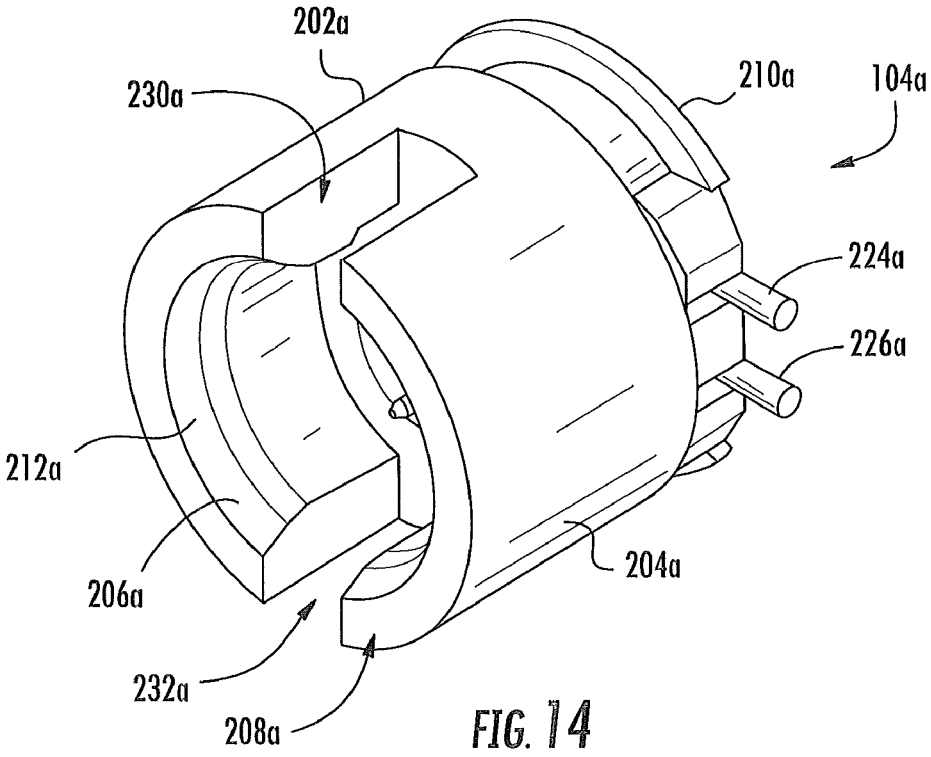
FIG. 14 is a perspective view of an alternative embodiment of the connector in FIG. 6 according to the present invention.

An alternative embodiment of a first connector 104*a* is illustrated in FIG. 14. First connector 104*a* has an outer body 202*a*, the outer body 202*a* having an outer surface 204*a* and inner surface 206*a*. The outer body 202*a* has a front end 208*a* and a back end 210*a* and is generally cylindrical in its configuration. The inner surface 206*a* defines an opening 212*a* extending between the front end 208*a* and the back end 210*a*. The first connector 104*a* also has two electrical contacts 224*a*,226*a*. The outer body 202*a* of the first connector 104*a* has two slots 230*a*,232*a* that extend through the outer body 202*a* and between the inner surface 206*a* and the outer surface 204*a* for engaging the segmented portions 118. As noted above, instead of two slots 230*a*,232*a*, there could be only one slot and still fall within the scope of the present invention.

Figure 15:
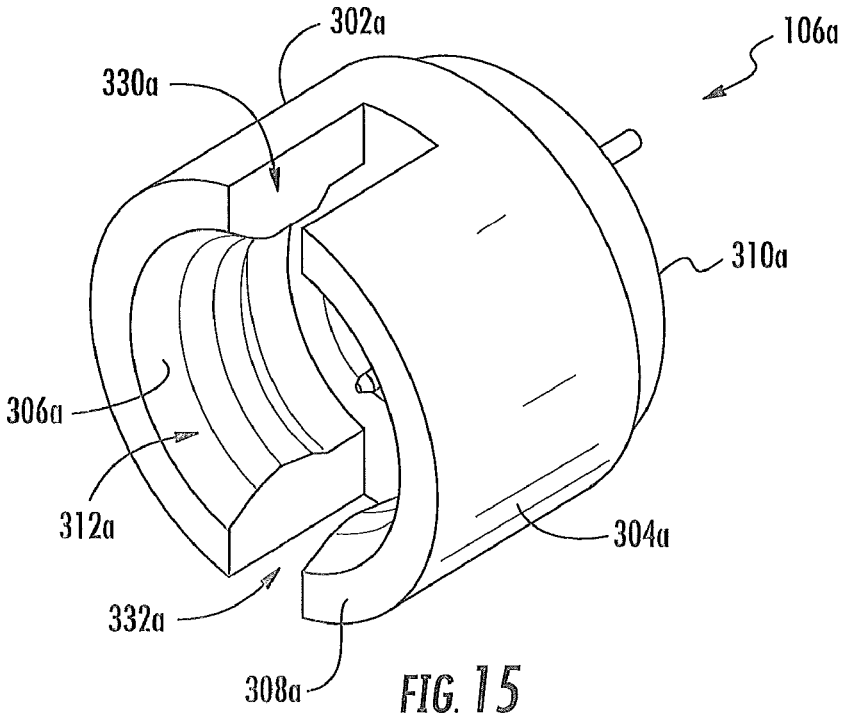
FIG. 15 is a perspective view of an alternative embodiment of the connector in FIG. 10 according to the present invention.

Similarly, the second connector 106*a*, described in conjunction with FIG. 15, has an outer body 302*a* with an outer surface 304*a* and an inner surface 306*a*. The inner surface 306*a* defines an opening 312*a* extending between the front end 308*a* and the back end 310*a*. The outer body 302*a* of the first connector 106*a* has two slots 330*a*,332*a* that extend through the outer body 302*a* and between the inner surface 306*a* and outer surface 304*a* for engaging the two segmented portions 118. Again, instead of two slots 330*a*,332*a*, there could be only one slot and still fall within the scope of the present invention.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A push-on high frequency differential interconnect comprising:

a tubular body having a central opening, a first end, and a second end, the first end and second end are segmented into a plurality of segmented portions, the plurality of segmented portions biased radially outward to engage and retain a corresponding connector, at least one of the plurality of segmented portions at each of the first and second ends biased radially outward beyond other segmented portions of the plurality of segmented portions to provide a key for the corresponding connector;

a dielectric member disposed in the central opening of the tubular body, the dielectric member having two openings therein to receive two electrical conductors; and an electrical conductor disposed in each of the two openings in the dielectric member.

2. The push-on high frequency differential interconnect according to claim 1, wherein the at least one of the plurality of segmented portions at each of the first and second ends biased radially outward beyond other segmented portions of the plurality of segmented portions comprises two of the plurality of segmented portions.

3. The push-on high frequency differential interconnect according to claim 1, wherein the two openings in the dielectric member and the at least one of the plurality of segmented portions lie on a single plane.

4. The push-on high frequency differential interconnect according to claim 1, wherein the two conductors, when connected, have a combined 100Ω impedance between the conductors.

5. The push-on high frequency differential interconnect according to claim 1, wherein the two conductors have a female configuration.

6. A push-on high frequency differential connector comprising:

an outer body having an outer surface, an inner surface, a front end, and a back end, the inner surface defining an opening extending between the front end and the back end, the inner surface having a slot extending from the front end to a middle portion;

a dielectric member inserted into the opening at the back end of the outer body, the dielectric member having two openings therein;

two electrical contacts disposed in the openings in the dielectric member, the electrical contacts extending towards the front end and beyond a front end of dielectric member; and a dielectric spacer engaging the two electrical contacts beyond the outer surface of the outer body, wherein the connector is adapted to mate with a push-on high frequency interconnect.

7. The push-on high frequency differential connector according to claim 6, wherein the inner surface has two slots extending from the front end to the middle portion and being on opposite sides of the opening.

8. The push-on high frequency differential connector according to claim 6, wherein the two electrical contacts and the slot lie on a single plane.

9. The push-on high frequency differential connector according to claim 6, wherein the inner surface at the front end of the outer body has a chamfer to assist in engaging a connector sleeve.

10. The push-on high frequency differential connector according to claim 6, wherein the electrical contacts turn through an angle of about 90° adjacent the back end of the outer body and extend radially outward from the opening beyond the outer surface.

11. The push-on high frequency differential connector according to claim 6, wherein the contacts have a male configuration.

12. The push-on high frequency differential connector according to claim 6, wherein the outside surface is generally circular in cross section.

13. The push-on high frequency differential connector according to claim 6, wherein the slot extends through the outer body from the inner surface to the outer surface.

14. The push-on high frequency differential connector according to claim 6, wherein the dielectric spacer and the dielectric member are a unitary element.

15. A push-on high frequency differential pair system comprising:

push-on high frequency differential interconnect comprising:

a tubular body having a central opening, a first end, and a second end, the first end and second end are segmented into a plurality of segmented portions, the plurality of segmented portions biased radially outward to engage and retain a corresponding connector, at least one of the plurality of segmented portions at each of the first and second ends biased radially outward beyond other segmented portions of the plurality of segmented portions to provide a key for the corresponding connector;

a dielectric member disposed in the central opening of the tubular body, the dielectric member having two openings therein to receive two electrical conductors; and an electrical conductor disposed in each of the two openings in the dielectric member; and a push-on high frequency differential connector comprising:

an outer body having an outer surface, an inner surface, a front end, and a back end, the inner surface defining an opening extending between the front end and the back end, the inner surface having a slot extending from the front end to a middle portion;

a dielectric member inserted into the opening at the back end of the outer body, the dielectric member having two openings therein;

two electrical contacts disposed in the openings in the dielectric member, the electrical contacts extending from the back end towards the front end and beyond a front end of dielectric member, the electric contacts extending radially outward from the opening beyond the outer surface; and a dielectric spacer engaging the two electrical contacts beyond the outer surface of the outer body.

16. The push-on high frequency differential pair system according to claim 15, wherein the dielectric spacer and the dielectric member are a unitary element.

* * * * *